US005614030A

United States Patent [19]

Braun

[11] Patent Number: 5,614,030

[45] Date of Patent: Mar. 25, 1997

[54] METHOD OF CLEANING A SHAVING HEAD OF A DRY SHAVING APPARATUS

[75] Inventor: Gebhard Braun, Kelkheim, Germany

[73] Assignee: Braun Aktiengesellschaft, Kronberg, Germany

[21] Appl. No.: 371,498

[22] Filed: Jan. 11, 1995

[30] Foreign Application Priority Data

Jan. 26, 1994 [DE] Germany ..... 44 02 236.0

[51] Int. Cl.[6] ..... B08B 9/00

[52] U.S. Cl. ..... 134/22.1; 134/22.11; 134/23; 134/34

[58] Field of Search ..... 15/303, 310, 311; 134/182, 184–87, 190, 192, 188, 189, 110, 109, 111, 10, 23, 24, 22.1, 22.11, 32–34, 152, 135, 139, 169 R, 104.2, 1

[56] References Cited

U.S. PATENT DOCUMENTS

| | | | |
|---|---|---|---|
| 3,172,416 | 3/1965 | Simmons | 134/111 |
| 3,480,022 | 11/1969 | Richardson et al. | 134/112 |
| 3,876,649 | 4/1975 | Schimke | 134/95.2 |
| 3,908,691 | 9/1975 | Schimke et al. | 134/95.2 |
| 4,054,963 | 10/1977 | Taylor | 15/310 |
| 4,442,596 | 4/1984 | Nasu et al. | 30/41.5 |
| 4,549,352 | 10/1985 | Ochiai | 30/41.5 |
| 4,631,825 | 12/1986 | Kuriyama et al. | 30/43.92 |
| 5,064,521 | 11/1991 | Stepanenko et al. | 204/224 M |
| 5,318,356 | 6/1994 | Shelton | 312/223.1 |
| 5,335,394 | 8/1994 | Cunningham, Jr. et al. | 15/302 |

FOREIGN PATENT DOCUMENTS

| | | |
|---|---|---|
| 2429372 | 6/1974 | Germany . |
| 6178876 | 6/1994 | Japan . |
| 0337132 | 11/1930 | United Kingdom . |
| 1206792 | 9/1970 | United Kingdom . |
| 1206791 | 9/1970 | United Kingdom . |
| 2129732 | 5/1984 | United Kingdom . |

OTHER PUBLICATIONS

Black & Decker®, PowerPro®, DustBuster Plus® Cordless Vacs, Black & Decker 1989,1990 pp. 4, 8–9.

EP Search report dated May 16, 1995.

A copy of a European Search Report dated Mar. 23, 1995.

*Primary Examiner*—Jill Warden

*Assistant Examiner*—Alexander Markoff

*Attorney, Agent, or Firm*—Fish & Richardson, P.C.

[57] ABSTRACT

The invention is directed to a control arrangement for the cleaning device 5 of a dry shaving apparatus 1, including a cradle structure 7 into which the shaving head 3 of the dry shaving apparatus 1 is insertable, wherein the cradle structure 7 is supplied with fluid from a container 6 by a feed device. Associated with the cradle structure 7 is an air drying device, with the feed device and the air drying device being activatable by an electric device provided with a switching means 9 which controls in succession the individual stages of the cleaning and drying cycle of the shaving head 3.

14 Claims, 9 Drawing Sheets

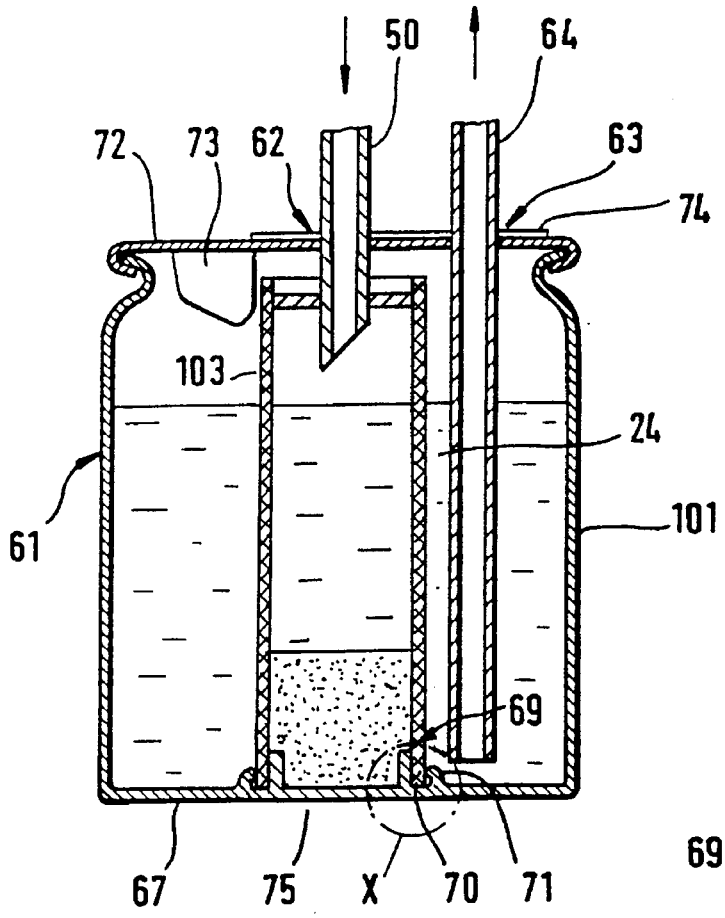
Fig. 7
Fig. 8
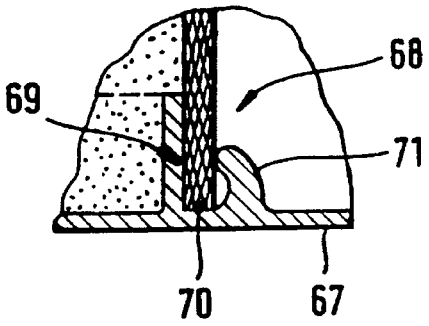
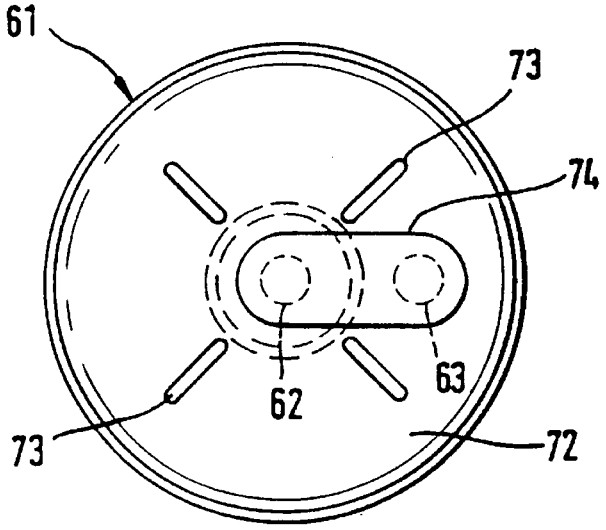
Fig. 9

METHOD OF CLEANING A SHAVING HEAD OF A DRY SHAVING APPARATUS

This invention relates to a method of cleaning a shaving head of a dry shaving apparatus, in which during a first stage of a cleaning cycle cleaning fluid is conveyed through the shaving head of the dry shaving apparatus by feed means.

From prior U.S. Pat. No. 3,172,416 a cleaning device for the cutter portion of a dry razor is known, comprising a cleaning casing in the upper area of which a seat is provided for receiving therein the cutter portion of an electric razor. According to a first embodiment, the individual components of the cutter portion are cleaned by a continuous stream of air directed to the cutter portion through an impeller means and filter elements. However, in cases where the cutter portion is severely contaminated carrying, for example, sebum, that is, grease particles, cleaning the cutter portion by means of an air stream is not accomplishable to the desired degree. The entire casing of the cleaning device through which air is blown is required to be sealed tight relative to atmosphere to prevent the swirled up hair dust from penetrating to the outside.

The same applies also to the cleaning device according to another embodiment (U.S. Pat. No. 3,172,416) in which the cutter portion is cleaned by a cleaning fluid directed for this purpose through fluid channels provided in the casing. For the full duration of the cleaning cycle, the cutter portion is seated in a cradle which is provided in the upper part of the casing and is at all times filled to capacity with cleaning fluid circulating therethrough. To accomplish this, a feed pump is provided in the casing. Because the cleaning fluid is not filtered during the cleaning operation, hair particles enter the cradle again and again, thus reaching the area of the cutter portion, so that this cleaning operation is equally not suited to accomplish satisfactory results, the less so since after deactivation of the pump device cleaning fluid with hair particles remain in the cradle, being thus prevented from being completely removed from the cutter portion. On termination of the cleaning cycle, it is necessary for the razor to be removed from its cradle to allow the cutter portion to drain and to be subsequently dried in the air. In this arrangement, the hair particles entrained with the cleaning fluid continue to adhere to the components of the cutter portion, so that ultimately a perfect cleaning action of the cutter portion is not achieved.

The known cleaning device does not include provisions for monitoring or controlling the individual operating cycles by a control arrangement in such a manner as to enable the shaving apparatus to be cleaned and dried thoroughly.

From French Pat. No. 2,568,111 a device for cleaning a shaving head of a dry shaving apparatus is known, in which the shaving head is introduced through a wall configured as a membrane into a cleaning chamber, being subsequently held in a cleaning position by the wall of a lid. By means of air caused to flow by a fan means and/or a suction means, only loose hair dust, yet excluding hair dust adhering to the shaving head, is blown out or extracted and then transferred to a filter means. The additional cleaning actions proposed in combination with the suction device as performed by a brushing device, a vibrating device or an ionization device, are not suited for dislodging sebum with or without hair dust from all components of a shaving head—the inside of the shaving head frame, the outer cutter, the inner cutter—not even when the shaving head has been previously removed from the housing of a dry shaving apparatus or disassembled.

It is an object of the present invention to provide a method of cleaning the shaving head of a dry shaving apparatus by means of which a thorough cleaning operation of the shaving head can be accomplished with the aid of a cleaning fluid.

According to the present invention, this object is accomplished by a method of cleaning a shaving head of a dry shaving apparatus, in which during a first stage of a cleaning cycle, cleaning fluid is conveyed through the shaving head of the dry shaving apparatus by feed means, characterized in that, following completion of the first stage of the cleaning cycle, the cleaning fluid is automatically drained from the shaving head of the dry shaving apparatus in a second stage, with the feed means being deactivated and the dry shaving apparatus being positioned such that the shaving head is arranged above a fluid level of the cleaning fluid.

In the embodiment of this method it proves advantageous that a drying operation is performed on the shaving apparatus following termination of the cleaning operation, so that the dry shaving apparatus is immediately available again for a new shave after the cleaning cycle is completed.

Preferred embodiments include one or more of the following features. The dry shaving apparatus may be in operation during the first and/or the second stage of the cleaning cycle. This provides the advantage that in operation of the dry shaving apparatus during the first stage the cleaning effect is intensified, while in operation of the dry shaving apparatus during the second stage the cleaning fluid is "shaken off", thus speeding up the drying process of the shaving apparatus.

The feed means may be a component part of the cleaning device. The cleaning device may include an electric device by which current can be supplied to the dry shaving apparatus, with the dry shaving apparatus being supplied with current as it is cleaned by the cleaning device. Thus, the operation of a dry shaving apparatus ensures a more rapid and at the same time thorough cleaning action of the shaving head, in particular of its cutter elements.

The dry shaving apparatus may be operated by an accumulator arrangement, and that the first stage of the cleaning cycle is not started until the accumulator arrangement is charged to a defined minimum level. Thus, deep discharges of the accumulators of the dry shaving apparatus can be avoided.

The intensity of the cleaning cycle may be variable. Thus, intensity of the cleaning cycle (and thus also the duration of the cleaning cycle and/or the consumption of cleaning fluid) can be adapted to the degree of contamination of the shaving apparatus.

The intensity of the cleaning cycle may be adjustable by the user, thereby presenting a particularly simple possibility of adjusting the cleaning operation to the desired intensity.

In this connection, in an embodiment in which the intensity of the cleaning cycle is variable by varying the duration of the first stage and/or by varying the feed rate of the feed means the method presents simple possibilities of varying the intensity of the cleaning cycle.

The dry shaving apparatus may continue to be in operation for a predetermined period of time following completion of the second stage. Thus, a particularly superior cleaning of the dry shaving apparatus can be accomplished in that the cleaning fluid is shaken off from the shaving head for a predetermined period of time.

The method may include a third stage which involves activation of a drying device that is started following completion of the second stage of following expiration of the predetermined time period. Thus, drying of the dry shaving apparatus can be expedited.

The drying device may be comprised of a fan means for conveying air and/or a heating means, thereby providing a simple way of implementation of the drying device.

The dry shaving apparatus may be held locked in the cleaning device during the cleaning cycle, thereby making it is possible to prevent the operator from interrupting the cleaning cycle for a shave. It is thereby ensured that the user is not allowed to shave until after the full cleaning cycle is completed and the dry shaving apparatus is dry again at the end of the cleaning cycle.

Further advantages and details of the present invention will become apparent from the subsequent description and the accompanying drawings explaining in more detail the method of cleaning a shaving head of a dry shaving apparatus, reference being had to an embodiment of a cleaning device without being limited to this particular embodiment. In the drawings, FIG. 1 is a partial sectional view of a cleaning device in which a shaving apparatus is received;

FIG. 7 is a view of the cleaning fluid container configured as a cartridge, with an integrally formed filter means according to FIG. 6;

FIG. 8 is a partial view of the fastening structure of the lower part of the filter means in the casing of the cleaning fluid container;

FIG. 9 is a top plan view of the cleaning fluid container of FIG. 7 configured as a cartridge and including locating means;

Figure 1:
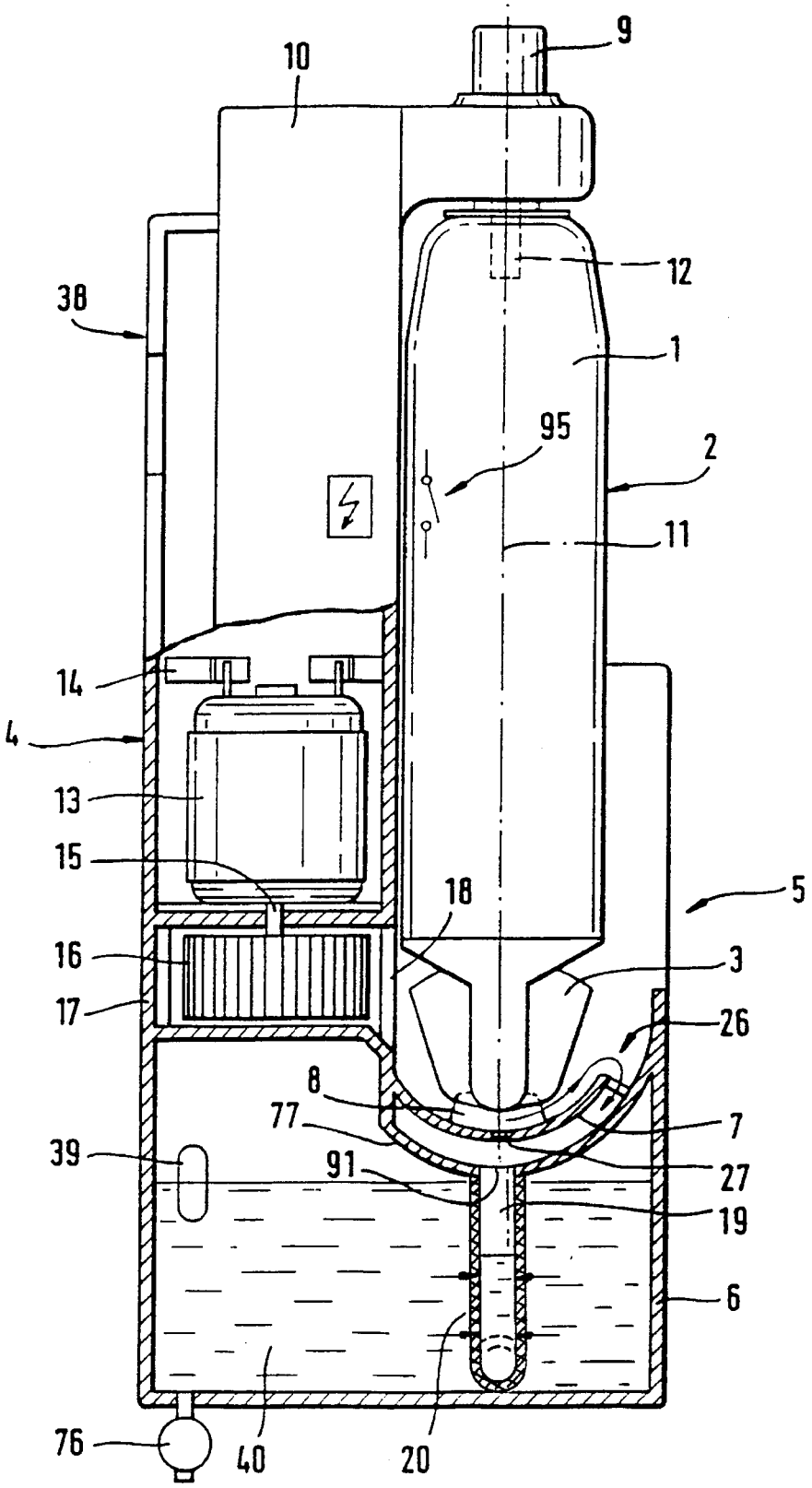

Referring now to FIG. 1 of the drawings, there is shown an electric shaving apparatus or shaver 1 including a housing 2 and a shaving head 3 with an inner cutter, not shown in the drawings, the shaving head being pivotal relative to the housing 2 from the mid-position shown into opposite directions about a pivot axis.

The shaving apparatus 1 is received in a casing 4 of a cleaning device 5. The cleaning device 5 is comprised of a cleaning fluid container 6 containing a fat-dissolving cleaning fluid 40 and of a cradle structure 7 configured as a cleaning dish, a drying dish and a storage means. Being slightly dished inwardly, the cradle 7 conforms approximately to the outer contour of the shaving head 3 of the shaving apparatus 1, and it holds only as much cleaning fluid as is necessary for the respective cleaning operation.

The cleaning device 5, in particular the wet portion thereof, that is, the cradle 7, is configured as a cleaning system open to atmosphere, whilst the cleaning fluid container 6 may be either open or, as will be subsequently described with reference to an embodiment (FIG. 7), partially or entirely closed.

With its shaving head 3 in an inverted position, the shaving apparatus 1 is seated in the upwardly open cradle configured as wet portion. During the cleaning cycle, cleaning fluid is continuously flushed through the cradle 7. At a particular level of contamination, the cleaning fluid may be drained through a closable conduit 76, and fresh fluid may be substituted.

The cradle 7 includes an overflow device 26 which prevents the cleaning fluid in the cradle 7 from exceeding a defined level and ensures that only the shaving head 3 or the lower part of the shaving head is immersed in cleaning fluid. Further, the bottom of the cradle 7 includes an outlet port 27 allowing the cleaning fluid with hair particles to be completely drained into the cleaning fluid container 6 through a hose member 20 permeable to fluid after the cleaning cycle is completed. However, the outlet port 27 is dimensioned such that the cradle 7, when supplied with cleaning fluid from a pump 3 described in the following, rather than being allowed to run empty, is at all times kept filled to the rim, with excess cleaning fluid being mainly discharged over the rim of the cradle 7 in the direction of the arrow, collecting in the cleaning fluid container 6 underneath. In this manner, a sufficient amount of cleaning fluid is at all times available for the cleaning cycle. Arranged below the cradle 7 is a collecting dish 77 of an equally concave configuration conforming to the cradle 7, which dish is connected to the overflow device 26 or is a part of said overflow device 26. As becomes apparent from FIG. 1, the shaving head 3 rests in the cradle 7 by means of elastic supporting means 8 serving to avoid damage to the shaving apparatus as it is placed down in the cradle 7 and to cushion the shaving apparatus during vibration.

Further, by means of a switching means 9 which may be configured as a start button and is mounted in a bracket 10, the shaving apparatus 1 (FIG. 1) is mechanically and/or electrically interlocked. The bracket 10 is fixedly connected with a wall mount 38 enabling the complete cleaning device 5 with the shaving apparatus 1 to be mounted on a wall or, alternatively, to be kept in a stand for storage.

The wall mount 38 and the bracket 10 open to the right when viewing FIG. 1 as well as the cradle 7 with the cleaning fluid container 6 combine to form the cleaning device 5 which is a unit of U-shaped cross-section. The shaving apparatus 1 may continue to be stored in the wall mount 38 also upon completion of the cleaning cycle, because all cleaning fluid is drained from the wet portion or the cradle 7 after cleaning is terminated. The shaving apparatus 1 may also remain in the wall mount 38 for recharging. The cleaning device 5 is suitable for utilization with any type of electric shaving apparatus.

The switching means 9 is arranged so as to be displaceable in the direction of a longitudinal center line 11 of the shaving apparatus 1 and is connected, by means of an electric control device 29, to timing elements serving to control the cleaning cycle.

The switching means 9 has at its lower end two relatively spaced contact means 12 for establishing contact with or supplying current to the shaving apparatus 1, which contact means, on depression of the switching means 9, cooperate with corresponding contact means of the shaving apparatus 1. In this manner, the shaving apparatus 1 can be set in operation when the switching means 9 is depressed and a power cord, not shown, of the cleaning device 5 is connected to an electrical outlet.

Adjacent to the shaving apparatus 1 in the casing 4 of the cleaning device 5 is an electric motor 13 having two electrical contact lugs 14 for connection to the electricity supply. Provided at the lower end of the electric motor 13 is a motor output shaft 15 on which an impeller or impeller wheel 16 is arranged serving in particular for drying the cleaned shaving head 3 of the shaving apparatus 1 following termination of the cleaning cycle of the shaving head 3 described in more detail in the following. The impeller 16 sits in an impeller casing 17 communicating through an opening 18 with the space above the cradle 7, and it directs a continuous stream of hot air heated by a heating means, not shown in the drawings, against the shaving head 3 to effect a drying action following the cleaning operation.

As mentioned in the foregoing, the bracket 10 combines with its vertically extending leg, a vertically extending leg of the wall mount 38 and the cradle 7 to form the U-shaped casing 4 when viewing the cleaning device 5 from the side, in which casing the shaving apparatus 1 is readily insertable from the side by imparting to it a lateral tilting motion, to be kept therein for storage.

According to FIG. 1, the cradle 7 extends into the cleaning fluid container 6 which is filled with cleaning fluid to two thirds, maximum. Adjoining the underside of the cradle 7 is a connection means 19 to which the porous hose member 20 is fitted which is permeable to the fluid entering the container 6 and prevents contaminants from penetrating into the cleaning fluid container 6 and settling at the bottom thereof. The connection means 19 may be of a porous configuration like the hose member 20, allowing the passage of fluid therethrough to the container 6.

The connection means 19 is fixedly connected with an opening 91, the collecting dish 77 and the overflow device 26.

The cleaning fluid container 6 may be provided with a fluid level indicating means 39 enabling the amount of spent cleaning fluid to be monitored at all times. According to FIG. 1, the fluid level indicating means 39 may be configured as a small viewing window. In lieu of the viewing window, it is also possible to provide an electronic indicating means comprising suitable sensors indicating the fluid level or also the degree of contamination of the cleaning fluid 40. For example, when the fluid is contaminated to a degree which must not be exceeded, this condition may be indicated by the sensors, thus informing the operator of the need to drain the cleaning fluid 40 through the conduit 76 for replacement. Depending on the embodiment, the sensors may also be used for de-activating the electric control electrodes, thereby automatically interrupting the cleaning cycle and compelling the operator to replace the cleaning fluid.

Figure 2:
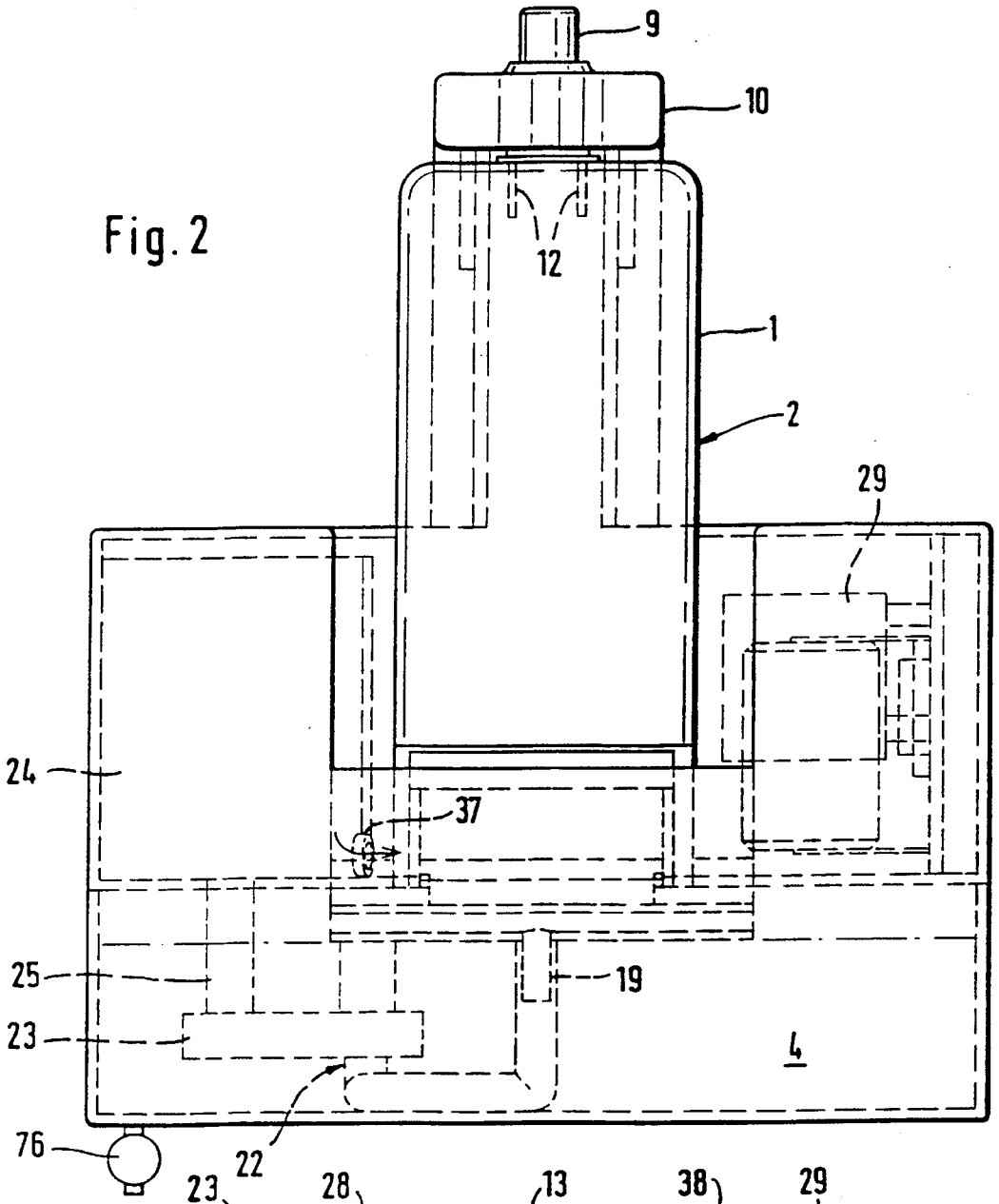
FIG. 2 is a front view of the cleaning device of FIG. 1.

As becomes apparent from FIG. 2, the connection means 19 is in communication with an intake connection means 22 of the feed pump 23 which delivers the cleaning fluid to a filter means 24 through a conduit 25.

To perform the cleaning cycle, the shaving apparatus 1 to be cleaned is introduced into the cleaning device 5 from the side and subsequently locked in place by the switching means 9 which, initially occupying its upper position, is for this purpose displaced downwards into a second position until the two contact lugs engage the contact means 12 provided in the shaving apparatus 1. The shaving apparatus 1 is thereby interlocked electrically and mechanically, allowing the operator to withdraw the shaving apparatus 1 not until after the cleaning and the subsequent drying cycle have been completed, canceling the interlock.

Figure 4:
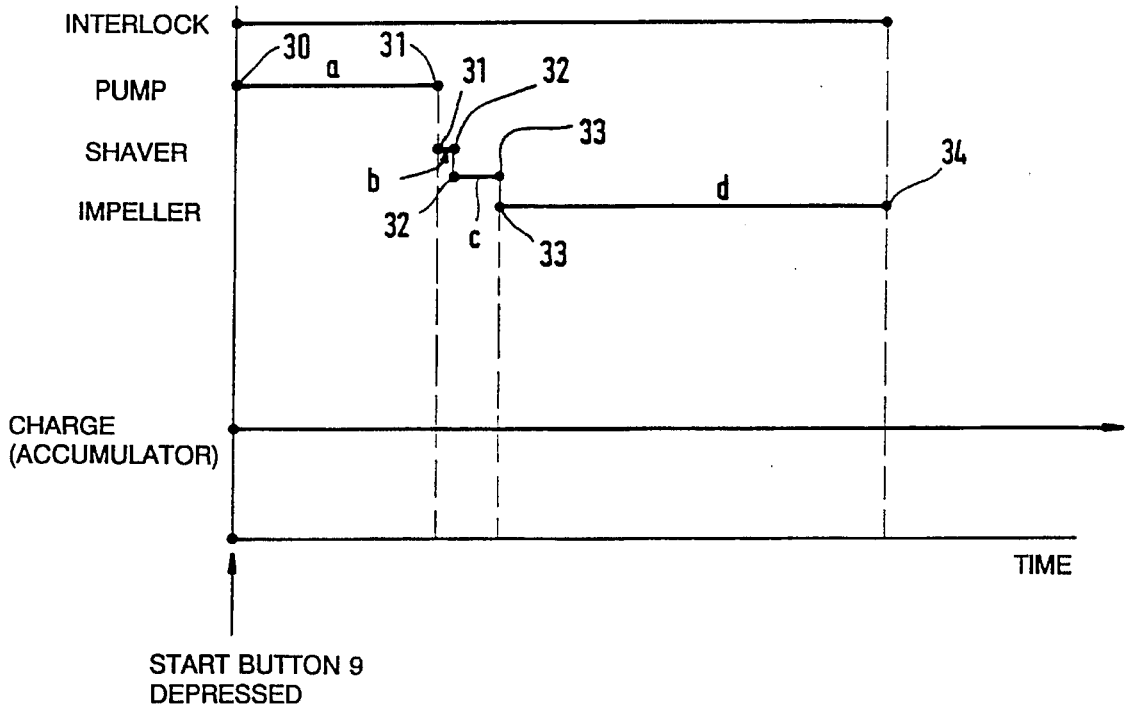
FIG. 4 is a schematic diagram depicting the individual cleaning stages as a function of time.

Operation of the switching means 9 causes the feed pump 23 to be driven which then delivers cleaning fluid 40 to the cradle 7 and to the shaving head 3 for a predetermined period of time, the fluid dislodging all of the hair dust 75 in the shaving head 3 (see segment 30 to 31 in FIG. 4).

The cleaning fluid with the hair dust then passes through the outlet port 27, the cradle 7 and the overflow device 26 to the hose member 20 permeable to the fluid flowing to the container 6, and onwards directly to the feed pump 23 and back to the filter means 24. As this occurs, some of the fluid will, of course, also flow to the cleaning fluid container 6 through the hose member 20. This has the advantage that the cleaning fluid with the complete hair dust 75 from the shaving apparatus 1 is delivered in concentrated form to the filter means 24 in which the cleaning fluid is completely cleaned. The hose member 20 thus ensures that hair particles can not enter the cleaning fluid container 6 through the hose member 20 and that hair dust is not allowed to settle in the cleaning fluid container 6.

The feed pump 23 is permanently connected to the cleaning fluid container 6 through the hose member 20 permeable to the fluid, as a result of which fluid is supplied thereto at all times without air being drawn in, not even when the pump is turned on at the start of a cleaning cycle and the piping has drained its fluid to the cleaning fluid container 6. The cleaning fluid cleaned in the filter means 24 is conveyed to the cradle 7 through an outlet connection means 37 of the filter means 24.

Figure 3:
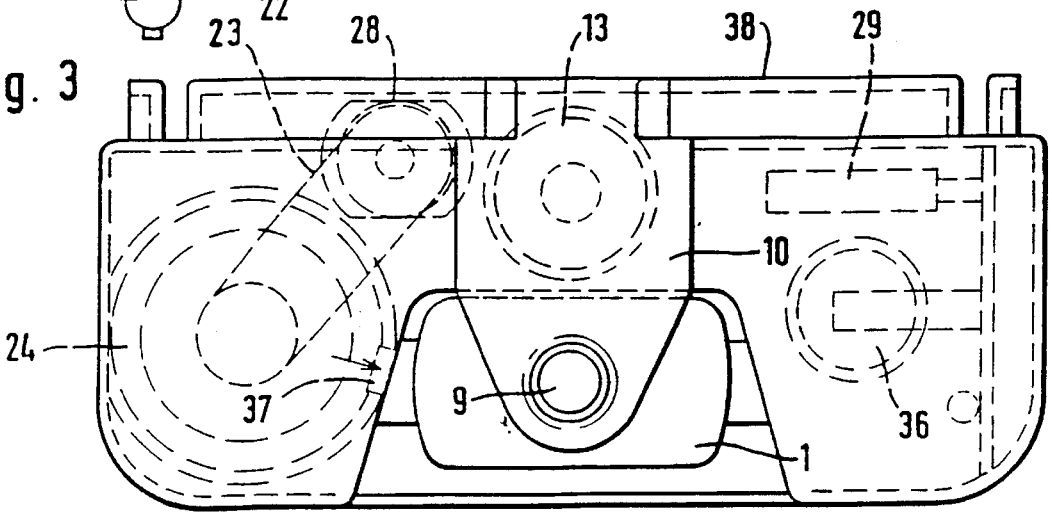
FIG. 3 is a top plan view of the cleaning device of FIG. 2.

FIG. 3 shows schematically in top plan view the arrangement of the essential parts of the cleaning device 5 including, for example, the feed pump 23 and an associated motor 28 which is turned on by the switching means 9. When viewing this Figure, there is shown to the right of the bracket 10 supporting the shaving apparatus 1 the electric control device 29 including timing elements, not shown, for controlling the individual stages of the cleaning cycle. Further arranged in the area of the bracket 10 is the motor 28 adapted to drive directly the impeller 16 which is operatively associated with a heating means for heating the air used for drying the shaving apparatus 1.

To be able to step the line voltage down to the requisite operating voltage, the cleaning device 5 is provided with a transformer 36.

FIG. 4 is a schematic diagram depicting the individual stages of the cleaning cycle as a function of time. The individual segments between points 30 to 34 show the individual cyclic stages of the cleaning device 5.

When, as initially mentioned, the switching means 9 is actuated at point 30 in FIG. 4 by downward displacement (control button 9 depressed), this has the concurrent effect of causing oscillation of the inner cutters, not shown, of the shaving apparatus 1, thereby producing in the shaving head 3 a flow with partially occurring cavitation which dislodges hair dust and grease particles from the inner cutters of the shaving head completely. Owing to the fluid being agitated, the fluid level in the cradle 7 is temporarily increased, while at the same time splashes are produced in the area of the shaving head 3 performing a thorough cleaning function on the shaving head 3 as well as the inner cutters although the level of the cleaning fluid reaches only part of the shaving head 3. Depending on the type of cleaning fluid utilized and the degree of contamination of the shaving head, the cleaning action lasts between 3 and 60 seconds (see segment a between points 30 and 31). When the shaving apparatus 1 is not cleaned at regular intervals, the cleaning cycle (segment a between points 30 and 31) is extended correspondingly. To accomplish this, the cleaning device may be provided with a two-step switch not shown in the drawings, the first step being intended for a regular cleaning cycle and the second step for an intensive cleaning cycle.

On completion of the cleaning cycle, the feed pump 23 is automatically turned off at point 31 (end of the cleaning cycle) of FIG. 4. This then enables the cleaning fluid to be drained completely through the outlet port 27, causing the wet portion or the cradle 7 to be evacuated. The level in the cleaning fluid container 6 rises a small amount. The outlet port 27 may also be closable by a valve, not shown in the drawings, which opens automatically when point 31 is reached. After about 30 seconds, the cradle 7 is completely emptied (see segment b between points 31 and 32, draining the cradle 7).

After the cradle 7 is drained at point 32, the shaving head 3 continues oscillating for some time, shaking off any cleaning fluid that may still adhere to the shaving head 3. After the set time has elapsed, the shaving apparatus 1 is turned off, and the inner cutter of the shaving head 3 stops moving at point 33 (end of the vibratory cycle). The turn-on and turn-off operations are accomplished by means of an electromagnetic reed switch 95 shown schematically which, according to FIG. 1, is accommodated in the housing 2 of the shaving apparatus 1. When the reed switch 95 is opened automatically on completion of the vibratory cycle, operation of the shaving apparatus 1 is also discontinued, initiating at point 33 the drying cycle described in the following (segment d).

Being automatically inserted in the circuit at point 33, the impeller 16 is turned on with or without heating means and driven by the electric motor 13, thus delivering dry air to the shaving head 3 for a predetermined period of time (see segment d between points 33 and 34). Then the interlock of the shaving apparatus 1 is deactivated at the control button 9.

Figure 6:
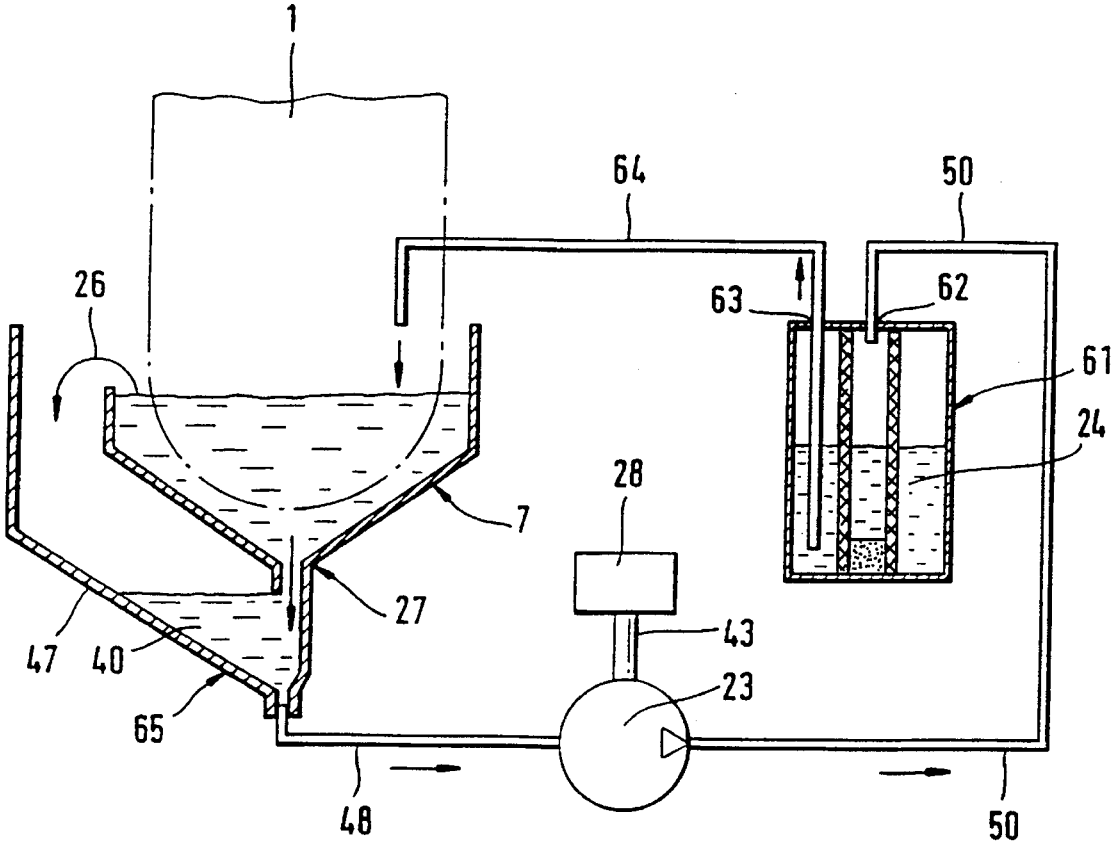
FIG. 6 is a schematic representation of the fluid circuit of the cleaning device, in particular between the cradle structure, the filter means and the cleaning fluid container configured as a cartridge.

FIG. 6 shows schematically the fluid circuit of the cleaning fluid 40. The cleaning device 5 incorporates the cradle 7 in which the shaving apparatus 1 is inserted in an inverted position so that the shaving head 3 is at least partially immersed in the cleaning fluid.

The cleaning device 5 further incorporates (FIG. 6) the feed pump 23 and the motor 28 connected to a supply of electricity through electrical lines and activatable by the switching means 9. The feed pump 23 is driven by the motor 28 adapted to bear against supporting means in the casing 4 of the cleaning device 5.

The shaft 43 projecting from the motor 28 drives the pump 23 provided in a pump casing.

As becomes further apparent from FIG. 6, a collecting reservoir 65 for receiving the cleaning fluid 40 is provided which is smaller than the cleaning fluid container 6 of the first embodiment. The collecting reservoir 65 has a bottom 47 arranged at an inclination, for example, at an angle of between 20° and 40° to prevent hair particles from collecting at the bottom 47. An intake connection means 48 of the feed pump 23 is attached to the lower area of the bottom 47, so that the cleaning fluid discharged over the overflow device 26 is conveyed, through the collecting reservoir 65, the intake connection means 48 of the feed pump 23 as well as a conduit 50, directly to the filter means 24 illustrated in greater detail in FIGS. 7, 8 and 9. The hair dust 65 collecting in the reservoir 65 is agitated in the cleaning fluid such that it is fed to the filter 24 and retained thereby, rather than being allowed to settle at the bottom 47 of the collecting reservoir 65. The filtered cleaning fluid is then circulated back to the cradle 7 through a conduit 64.

A cleaning fluid container 61 which is configured as a cartridge in FIG. 6 is provided with an outlet port 63 communicating with the cradle 7 through the conduit 64. In this manner, the cleaning circuit is closed.

According to this embodiment (FIG. 6), the switching means 9 activates the feed pump 23 configured as a vane-type pump drawing air at the beginning of the cleaning cycle and forcing this air through the conduit 50 into the cleaning fluid container 61 so that the cleaning fluid flows from the cleaning fluid container 61 through the outlet port 63 and the conduit 64 to the drained cradle 7, refilling it until the cleaning fluid is discharged to the collecting reservoir 65 over the overflow device 26. Part of the fluid is continuously drained through the outlet port 27. Considering, however, that the feed pump 23 delivers more fluid to the cradle 7 than can be drained through the outlet port 27, it is ensured that during the cleaning cycle the cradle 7 remains filled with fluid to the level of the overflow device 26.

The container 61 inlet and outlet ports 62, 63 shown in FIG. 7 may also be provided at a bottom 67 of the container 61, enabling the container 61 to be connected to suitable conduits from above. It is thereby achieved that a permanent flow of cleaning fluid is delivered from the container 61 to the intake of the pump 23, causing the pump to be under permanent fluid pressure which ensures that the pump draws only cleaning fluid, rather than air, when put into operation.

The container 61 or cartridge shown in FIGS. 7 to 9 is comprised of a cylindrical can structure 101 having a bottom 67 and a lid 72 in which the inlet port 62 and the outlet port 63 as well as the filter means 24 are provided.

The lid 72 is sealed relative to the upper rim of the container 61 by hemming such as to prevent it from being pulled off the can structure 101. The conduit 50 arriving from the pump 23 is connected to the inlet port 62, while the conduit 64 leading to the cradle 7 is connected to the outlet port 63. Quick-release coupling members, not shown in the drawings, may be provided in the area of the inlet and outlet ports 62, 63 to allow ready replacement of the cleaning fluid container 61 when it is necessary to renew the cleaning fluid or when the filter means 24 provided in the cleaning fluid container 61 has become clogged.

The degree of contamination or the hair dust 75 retained in the filter means 24 may be determined by means of an indicating device not shown in the drawings. The indicating device may include a pressure sensor and a telltale light indicating the degree of contamination or the pressure status. When the filter means 24 is no longer usable, the cleaning fluid container 61 is detached from the conduits 50, 64, and a new one is substituted.

In the embodiment of FIGS. 7 to 9, the filter means 24 is configured as a cylindrical paper filter arranged coaxially in the casing 101.

According to FIG. 8, the filter means 24 is forced with a lower end 70 thereof into engagement with an annular groove 68 provided at the bottom 67 of the can structure 101 coaxially with the can structure 101. The annular groove 68 is comprised of two relatively spaced parallel annular walls or hem flanges 69, 71 projecting from the bottom 67 so that the lower end 70 of the filter means 24 is clampingly engaged within the annular groove 68. The filter means 24 forms a first chamber receiving the hair dust, while the remaining part of the casing forms a second chamber for holding cleaned fluid.

As becomes apparent from FIG. 9, the upper lid 72 of the can 101 of the container 61 includes four relatively spaced locating means 73 arranged in cross shape and serving to locate the filter means in coaxial alignment within the cleaning fluid container 61.

The lid 72 (FIGS. 7, 9) further includes a foil 74 which is pierced by the conduits 50, 64 as the container 61 is inserted in the casing 4, thereby establishing the coupling engagement with the inlet and outlet ports 62 and 63, respectively. Conveniently, the two conduits 50, 64 may be provided with a sharp edge or tip 103 at their respective ends to facilitate piercing of the foil sealing the ports 62, 63. It is also possible to seal the ports 62, 63 by means of a pull-off strap under which sealing members capable of being pierced may be provided into which the conduits 50, 64 are inserted.

Figure 10:
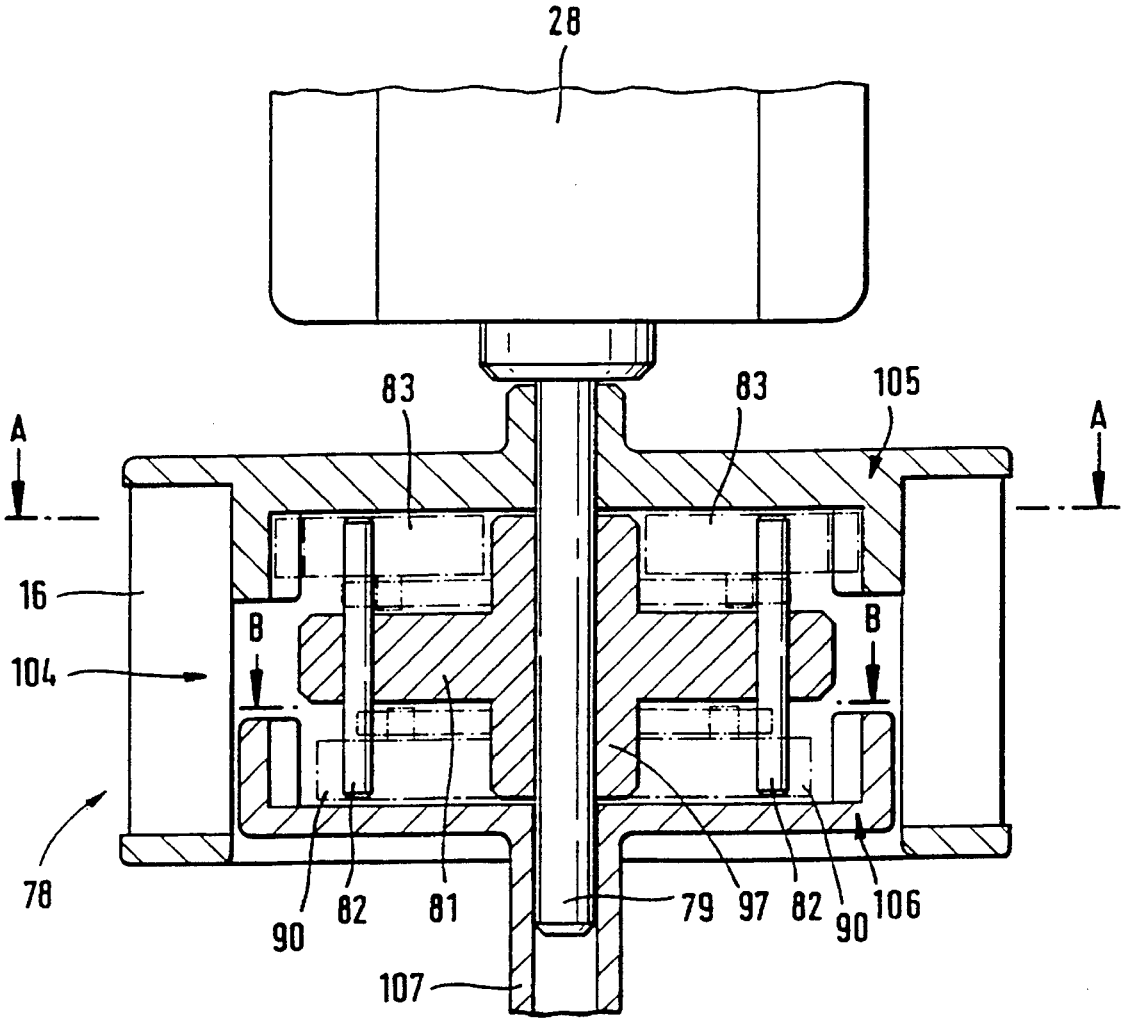
FIG. 10 is a sectional view of a drive mechanism for the impeller and the pump, including an overrunning device.
Figure 11:
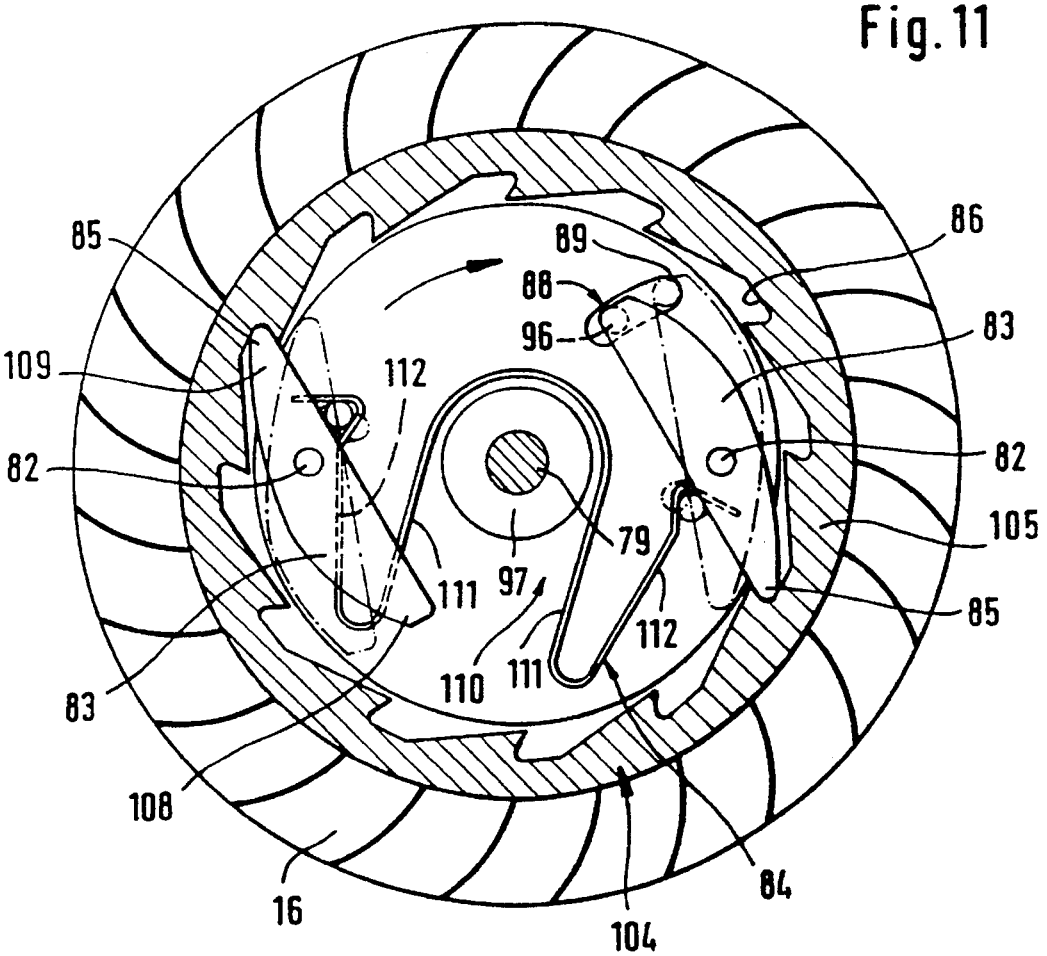
FIG. 11 is a sectional view taken along the line A—A of FIG. 10.
Figure 5:
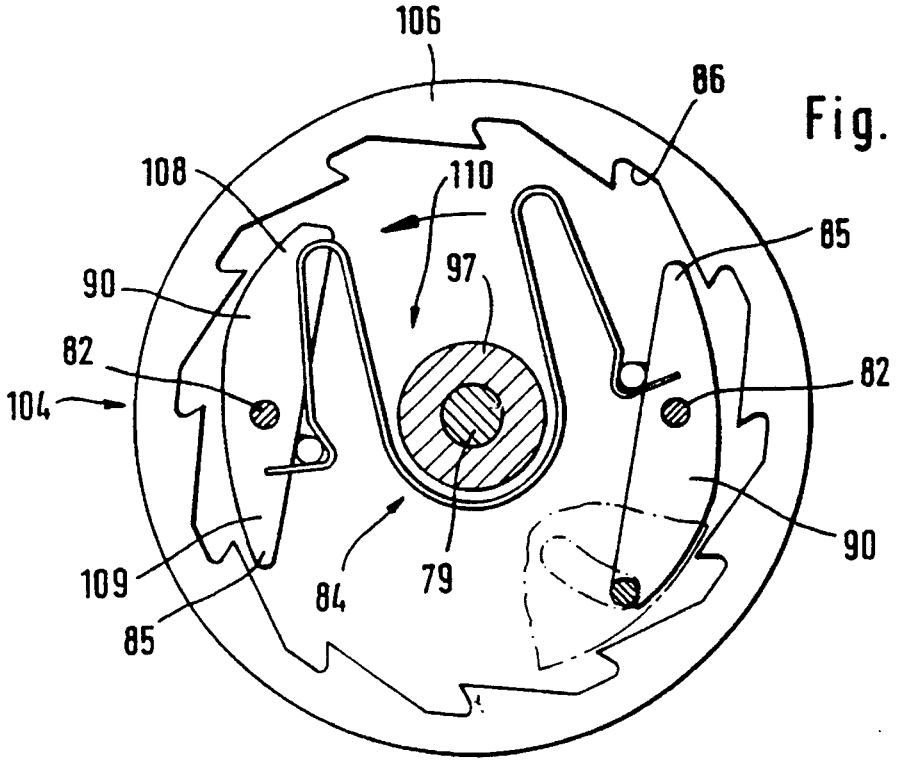
FIG. 5 is a sectional view taken along the line B—B of FIG. 10.

FIGS. 5, 10 and 11 illustrate a mechanism 78 for driving the impeller 16 and the feed pump 23. Since it is not desirable to drive the feed pump 23 and the impeller 16 at the same time, they may be driven selectively by the single motor 28. The drive mechanism 78 which also includes the motor 28 is provided with a device reversing the direction of rotation which includes one (FIG. 12) or, according to FIGS. 5 and 11, two overrunning devices 104, one driving the impeller 16 in a clockwise direction, the other driving the feed pump 23 in a direction opposite thereto.

Figure 12:
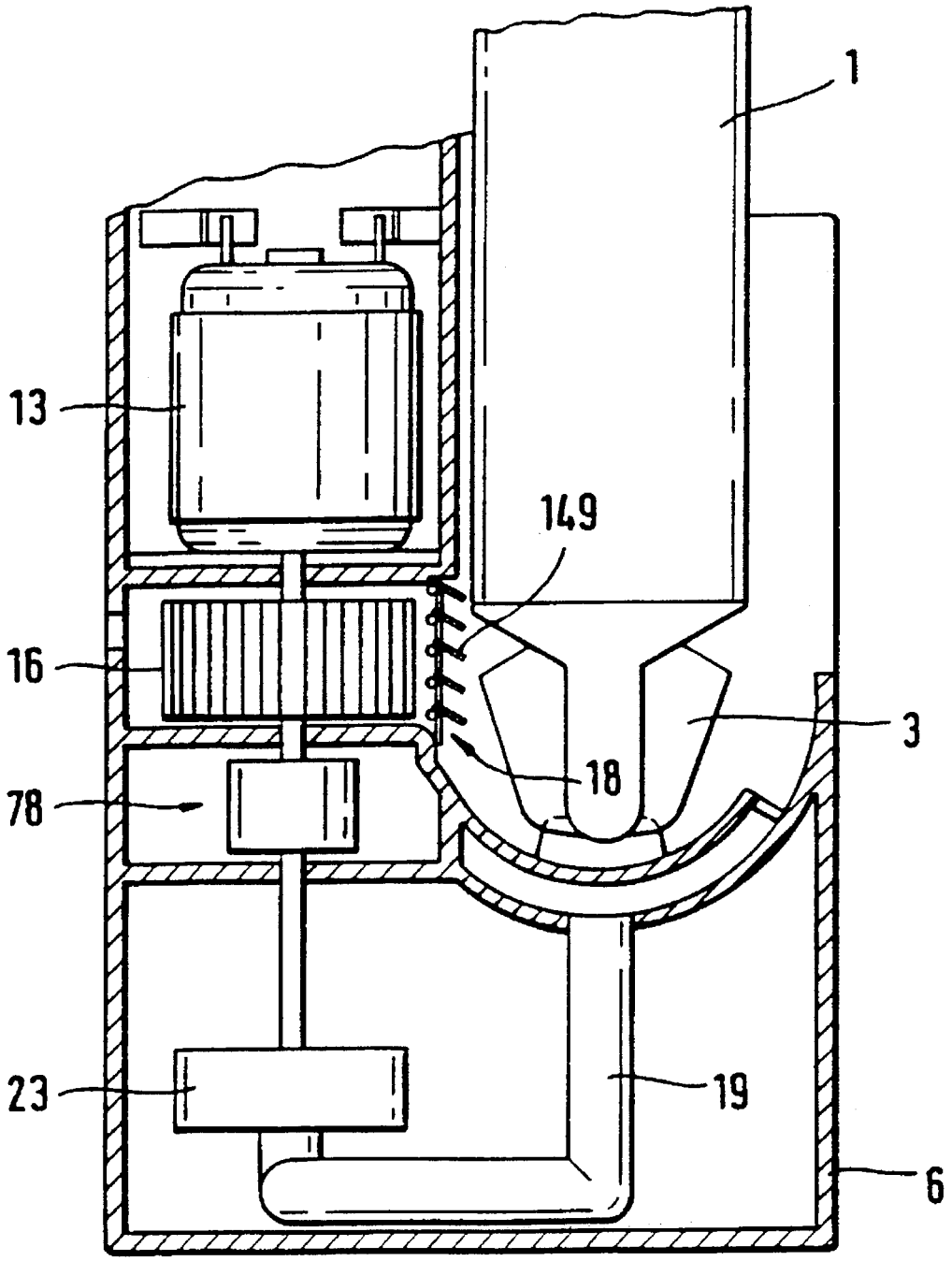
FIG. 12 is a view of a further embodiment of a drive mechanism for the pump and the drying device.

The device reversing the direction of rotation, together with the upper and the lower overrunning device 104, is seated on a motor output shaft 79 of the motor 28 on which also the impeller 16 is arranged. The overrunning device 104 may be provided with a clamp-type locking mechanism including for this purpose a one-way coupling with self-locking frictional engagement. Further, clamping rollers or clamping plates may be provided as coupling means. In the embodiment of FIGS. 11 and 12, the overrunning devices 104 are comprised of internal gear rings 105, 106 having an upper and a lower tooth flank 86. The two internal gear rings 105, 106 are mounted on the motor output shaft 79 so as to rotate freely. The motor output shaft 79 drives a driving flange 81 which includes two diametrically opposite pawl axles 82 receiving each an upper and a lower crescent-shaped pawl 83, 90. The pawls 83, 90 include each two lever arms 108, 109 of different length (FIG. 11), with the longer lever arm 108 being guided in a slotted hole 88 by means of a pin 96, while the other lever arm 109 bears against a spring 84. FIGS. 5 and 11 show each one slotted hole 88.

The pawl 83 (FIG. 11) is pivotal on the pawl axle 82 in the direction of the inner periphery of the impeller 16 between a position shown in solid lines and a position shown in broken lines by means of the spring 84 bent twice in V-shape. The spring 84 includes a U-shaped member 110 by means of which it is seated on a hub 97 of the driving flange 81. The U-shaped member 110 is formed of two legs 111 which, each in combination with a further adjoining leg 112, form a double V.

In the position illustrated in FIG. 11, the two pawls 83 have an outer end 85 thereof in engagement with the tooth flanks 86 of the gear ring 105 connected to the impeller 16, thus establishing a driving relationship, in a clockwise direction, of the motor 28 to the impeller 16. The legs 112 of the spring 84 urge, through an abutment means, the end 85 of the lever arm 108 into engagement with the tooth flank 86.

When the motor output shaft 79 is driven in a counterclockwise direction, the pawls 83 are first urged outwardly by the tooth flanks 86 and then, at a minimum rotational frequency, are pivoted on the pawl axle 82 outwardly in a clockwise direction in opposition to the action of the spring 84 owing to their eccentric arrangement on the pawl axle 82, until they engage a stop 89 of the slotted hole 88. This is accomplished in that the weight component of the lever arm 108 is greater than that of the other lever arm 109 of the pawl 83 relative to the pawl axle 82. As a result, the impeller 16 is disengaged from the motor output shaft 79. This position is maintained until the centrifugal moment has diminished due to a reduced rotational frequency to a level at which the spring moment prevails and the pawls 83 return to their engaged positions according to FIG. 11 (see the position of pawl 83 shown in solid lines).

By driving the motor output shaft 79 in a manner similar to the mode of operation of FIG. 11, yet in a counterclockwise direction, two further pawls 90 arranged below the driving flange 81 are then equally pivoted on the pawl axles 82 by means of the spring 84, their ends 85 engaging the tooth flanks 86, so that the pump 23 is operated by the same motor 28 and by a hollow shaft 107 disposed on the motor output shaft 79, whereas the two upper pawls 83 are maintained disengaged. At the beginning of the cleaning operation, only the pump 23 is driven according to FIG. 11, and the impeller 16 is released according to FIG. 5.

The two lower pawls 90 do not leave their engaged positions, thereby canceling the driving relationship of the motor 28 to the feed pump 23, until the direction of rotation of the motor 28 is changed. Because the outer ends of the pawls 83, 90 do not slip over the tooth flanks 86, noise and wear are prevented from occurring with the pawls 83, 90 running freely.

Owing to the advantageous driving relationship for selectively driving the feed pump 23 and the impeller 16, the requirement of having to provide a second drive motor for driving feed pump 23 and impeller 16 separately is obviated, so that cost savings may be realized.

The motor 28 and the impeller 16 as well as the pump 23 not shown in FIGS. 5, 10 and 11 and, if desired, the cleaning fluid container 61 may be arranged vertically on a common axis, which enables the number of gear parts between the motor 28, the pump 23 and the impeller 16 to be reduced to a minimum and, in consequence, allows the casing 4 of the cleaning device 5 to be built to smaller dimensions (see FIG. 12).

Figure 13:
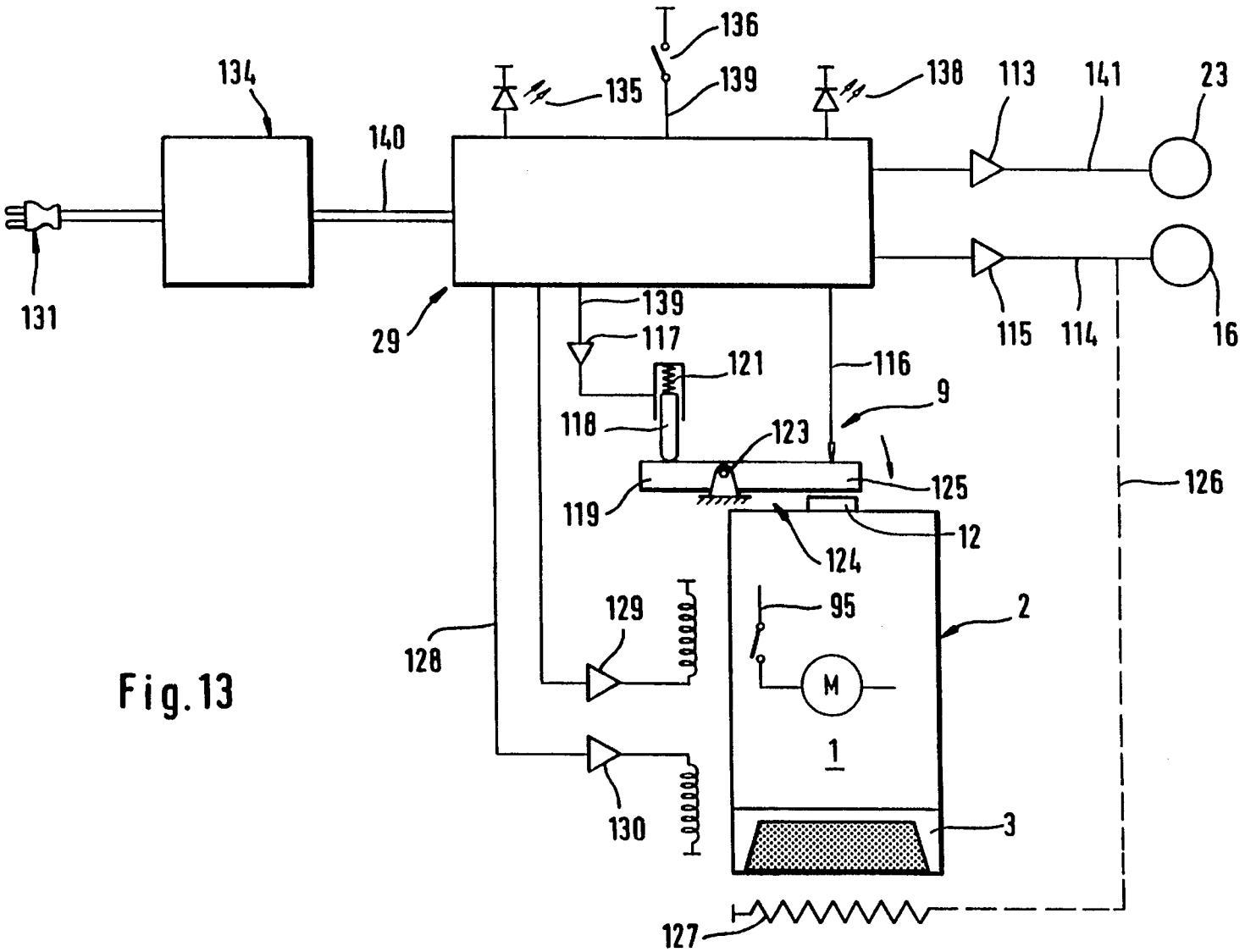
FIG. 13 is a view of a control arrangement for the cleaning device of the dry shaving apparatus for controlling the individual stages of operation.

In FIG. 13, reference numeral 29 designates a control arrangement or control device serving to control the cleaning and drying cycle of the dry shaving apparatus 1 illustrated in FIG. 1, which for this purpose is inserted in a cradle structure 7 configured as a cleaning dish. The control device 29 which in FIG. 13 is represented by the block diagram includes a line input or power plug 131 for connection to an electric power supply device. The power plug 131 is connected, through an electric line 140, to a low-voltage transformer device 134. The transformer device 134 is electrically connected to the time-controlled electronic control device 29. Connected to the control device 29 through an electric line 139 is a selector switch 136 which, in being switched over from the position shown in FIG. 13 into the second position, effects, for example, an extension of the cleaning cycle designated by a in FIG. 4.

The first output of the control device 29 is connected, via an amplifier 113 and an electric line 141, to the feed pump 23, enabling a corresponding control pulse to be transferred via the amplifier to the feed pump 23 in order to activate it at the beginning of the cleaning cycle and thus deliver cleaning fluid 40 to the cradle structure 7. Via a suitable timing element, the control pulse can be controlled in the control device 29 such that the feed pump 23 is not activated until a minimum charge level is available in the dry shaving apparatus. The second output or second output stage of the control device 29 is connected, via an electric line 114 and an amplifier 115, to the drying device or the impeller 16 which may be provided with a heating means 127 in order to supply the shaving head with dry air following the cleaning operation. A third output of the control device 29 is connected to an amplifier 129 which may be associated with suitable coils or sensors, causing the amplifier 129 to effect energization of the dry shaving apparatus 1 which for this purpose is provided with a suitable reed switch 95. When, for example, the dry shaving apparatus 1 is turned on via the amplifier 129, a timing element, not shown in the drawings, may act to cause activation of the shaving head 3 of the dry shaving apparatus 1 not until after the feed pump 23 has filled the cradle structure 7 with cleaning fluid. When the cleaning action is completed according to FIG. 4, a vibratory action corresponding to the segment b of FIG. 4 will follow whereupon the shaving apparatus is deactivated again via the amplifier 129, causing the shaving head 3 to discontinue its vibratory or oscillatory motion (segment c). A fourth output of the control device 29 is equally connected to the dry shaving apparatus 1 via a line 128 and an amplifier 130, checking by means of suitable sensors whether the dry shaving apparatus 1 is connected to the electrical supply.

The dry shaving apparatus 1 is interlocked mechanically and electrically by an actuating means or actuating arm 124 shown in FIG. 13 which is arranged or carried in the cleaning device 4 by means of a hinge pin 123. The actuating means 124 includes a first lever arm 119 and a second lever arm 125. The actuating means 124 also serves as a locking device. The end of the lever arm 125 establishes a current connection between the contact pins 12 of the dry shaving apparatus 1 and the electric control device 29 so that a downward displacement of the switching means 9 closes the circuit between the dry shaving apparatus 1 and the power supply device. The first lever arm 119 is operatively connected to the unlocking device through an actuating pin 118 and a spring 121. The unlocking device includes an actuating pin 118 which is connected to the control device 29 via an electric line 139. When the drying cycle is completed at point 34 of FIG. 4, the actuating means 124 and thus the unlocking device will be activated via the amplifier 117. The actuating means 124 interrupts the supply of current to the dry shaving apparatus 1, thus effecting at the same time the mechanical unlocking function, so that the dry shaving apparatus 1 can be removed from its cradle 7 if so desired.

However, as mentioned in the foregoing, the possibility also exists to leave the dry shaving apparatus 1 in its cradle 7 which thus serves at the same time the function of a permanent mounting structure.

In summary, cleaning and drying of the shaving apparatus proceeds according to the following steps: The dry shaving apparatus 1 with its shaving head seated in place is inserted into the cradle structure 7 as shown in FIG. 1, and the cleaning device can be connected to a supply of electricity unless it has been connected already. The cleaning action is initiated by operating the switching means 9, causing the dry shaving apparatus 1 to be interlocked mechanically via the actuating means 124. The mechanical interlock results at the same time in an electrical interlock, thereby establishing a supply of current via the contact pins 12, the actuating means 124 and the line 116 to the dry shaving apparatus 1. Then the charging cycle for the shaving apparatus 1 may be started. After the charge has reached a minimum level, the shaving head 3 is set in oscillation. At the same time, the amplifier 113 activates the feed pump 23, causing cleaning fluid to be supplied to the cradle structure 7 and thus also to the oscillating shaving head 3. After a period of time corresponding to the segment a of FIG. 4, the cradle structure 7 is automatically evacuated for a period of time corresponding to segment b, so that in the subsequent segment c the shaving head 3 can shake off any remaining fluid by continuing its oscillatory motion. Upon reaching point 33, the amplifier 115 activates the drying device or the impeller 16 which is connected to a heating means 127, shown schematically, via the electric line 126. As experience has shown, the ensuing drying cycle takes between 10 and 30 minutes, and it is reflected by the segment d in FIG. 4. The end of the drying cycle is reached at point 34 at which the amplifier 115 deactivates the impeller 16 again. At the same time, the actuating means 124 is displaced, equally via the amplifier 117 and the actuating pin 118, thereby canceling the mechanical interlock of the dry shaving apparatus 1. Canceling the mechanical interlock also interrupts the supply of power to the shaving apparatus via line 116. However, it is also possible to configure the actuating means 124 such that power supply continues to be ensured with the shaving apparatus 1 inserted, so that the shaving apparatus is recharged automatically after a prolonged period of non-use. By pivoting the actuating means 124 in a counterclockwise direction, the shaving apparatus 1 can be removed only if the full cleaning and drying cycle is completed. When this process and the individual process steps are not performed in the manner described, the actuating means 124 can not be displaced, preventing premature removal of the shaving apparatus 1.

The complete electric control device 29 with the individual amplifiers requires a minimum amount of space for accommodation in the interior of the casing 4 of the cleaning device, thus enabling it to be protected against humidity readily.

An operation indicating means 135 with the selector switch 136 informs the operator that the cleaning cycle is not completed as yet, while the indicating device 138 provides an indication that the cleaning cycle is completed.

I claim:

1. A method of cleaning a shaving head of a dry shaving apparatus using a cleaning device having a fluid feed mechanism in fluid connection with a fluid container, said method comprising the steps of:

positioning the shaving head at a position above a fluid level of the fluid container containing a cleaning liquid, activating the fluid feed mechanism to convey, during a first stage of a cleaning cycle, the cleaning liquid to a cradle, the dry shaving head being at last partially submerged in the cleaning liquid in the cradle such that the cleaning liquid is conveyed through the shaving the of the dry shaving aparatus, and deactivating the fluid feed mechanism, in a second stage following completion of the first stage of the cleaning cycle, to cause the cleaning liquid to automatically drain from the cradle.

2. A method as claimed in claim 1, wherein the dry shaving apparatus is activated during at least one of the first and second stages of the cleaning cycle.

3. A method as claimed in claim 1, wherein the fluid feed mechanism is a component part of the cleaning device, the cleaning device further including an electric device which supplies electric current to the dry shaving apparatus, the method further comprising supplying electric current to the dry shaving apparatus during cleaning of the dry shaving apparatus.

4. A method as claimed in claim 2, wherein the dry shaving apparatus is operated by an accumulator arrangement, and the first stage of the cleaning cycle is not started until the accumulator arrangement is charged to a defined minimum level.

5. A method as claimed in claim 1 wherein an intensity of the cleaning cycle is variable.

6. A method as claimed in claim 5, wherein the intensity of the cleaning cycle is adjustable by the user.

7. A method as claimed in claim 5 wherein the intensity of the cleaning cycle is varied by varying at least one of the duration of the first stage and the feed rate of the fluid feed mechanism.

8. A method as claimed in claim 1, wherein the dry shaving apparatus continues to be activated for a predetermined period of time following completion of the second stage.

9. A method as claimed in any one of the claims 1 to 8 further comprising activating a drying device during a third stage following completion of the second stage.

10. A method as claimed in claim 9, wherein the drying device comprises a fan, the method comprising conveying air to the shaving head with the fan.

11. A method as claimed in claim 1 further comprising locking the dry shaving apparatus in the cleaning device during the cleaning cycle.

12. A method as claimed in claim 9, wherein the drying device includes a heater, the method comprising heating the shaving head with the heater.

13. A method as claimed in claim 9 further comprising activating a drying device during a third stage after a predetermined time period following completion of the second stage.

14. A method as claimed in claim 1, wherein the step of deactivating the fluid feed mechanism in the second stage is performed with the shaving head maintained at the position above the fluid level of the fluid container.

* * * * *

UNITED STATES PATENT AND TRADEMARK OFFICE

CERTIFICATE OF CORRECTION

PATENT NO. : 5,614,030

DATED : March 25, 1997

INVENTOR(S) : Gebhard Braun

It is certified that error appears in the above-identified patent and that said Letters Patent is hereby corrected as shown below:

Col. 3, l. 16, insert (centered in the column) --Brief Description of the Drawings--.

Col. 3, l. 47, insert (centered in the column) --Detailed Description of the Invention--.

Col. 4, l. 3, insert --7-- before "configured".

Col. 4, l. 17, "3" should be --23--.

Col. 7, l. 50, "65" should be --75--.

Col. 12, l. 30, "last" should be --least--.

Col. 12, l. 32, "the" (3rd occurrence) should be --head--.

Col. 12, l. 33, "aparatus" should be --apparatus--.

Signed and Sealed this

Sixteenth Day of March, 1999

*Attest:*

Q. TODD DICKINSON

*Attesting Officer*

*Acting Commissioner of Patents and Trademarks*